US010454251B2

(12) United States Patent
Mugwyler et al.

(10) Patent No.: US 10,454,251 B2
(45) Date of Patent: Oct. 22, 2019

(54) DISCONNECTOR DEVICE FOR SURGE ARRESTER AND A PROTECTION ASSEMBLY COMPRISING A SURGE ARRESTER CONNECTED TO SUCH A DISCONNECTOR DEVICE

(71) Applicant: ABB Schweiz AG, Baden (CH)

(72) Inventors: Remo Mugwyler, Pittsburgh, PA (US); Nicola Gariboldi, Nussbaumen (CH); Joel Antelo, Wangen bei Olten (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/116,123

(22) Filed: Aug. 29, 2018

(65) Prior Publication Data

US 2018/0366916 A1 Dec. 20, 2018

Related U.S. Application Data

(63) Continuation of application No. PCT/EP2016/071500, filed on Sep. 13, 2016.

(30) Foreign Application Priority Data

Feb. 29, 2016 (EP) ..... 16157911

(51) Int. Cl.
*H01T 1/16* (2006.01)
*H01H 39/00* (2006.01)
(Continued)

(52) U.S. Cl.
CPC ..... *H01T 1/16* (2013.01); *H01H 37/76* (2013.01); *H01H 39/002* (2013.01); *H01C 7/126* (2013.01)

(58) Field of Classification Search
CPC ..... H01H 37/76; H01H 39/002; H01T 1/16; H01C 7/126
(Continued)

(56) References Cited

U.S. PATENT DOCUMENTS 5,191,503 A * 3/1993 Kawamura ..... H01C 7/126 174/2
5,650,772 A * 7/1997 Schmidt ..... H01T 1/12 324/133
(Continued)

FOREIGN PATENT DOCUMENTS

CN 101521065 A 9/2009
EP 1566869 A1 8/2005
(Continued)

OTHER PUBLICATIONS

European Patent Office, International Search Report & Written Opinion issued in corresponding Application No. PCT/EP2016/071500, dated Dec. 22, 2016, 11 pp.
(Continued)

*Primary Examiner* — Kevin J Comber
(74) *Attorney, Agent, or Firm* — Taft Stettinius & Hollister LLP; J. Bruce Schelkopf

(57) ABSTRACT

A disconnector device for a surge arrester is provided. The disconnector device includes: a housing encompassing a cavity; a disconnector provided inside the cavity, having a first terminal connectable to the surge arrester, a second terminal connectable to ground, a movable member provided at the second terminal and being fitted to the cross section of the cavity, and a disconnector cartridge. The member is movably arranged such in the housing that once the disconnector operates, the movable member is propelled inside the cavity towards an end of the cavity. The housing has ventilation openings connecting the cavity to an outside of the disconnector device for releasing gases from the operating disconnector cartridge. These ventilation openings are dimensioned such that no particles of harmful size that are potentially capable of igniting a fire can pass the ventilation openings.

19 Claims, 3 Drawing Sheets

(51) Int. Cl.
*H01H 37/76* (2006.01)
*H01C 7/12* (2006.01)

(58) Field of Classification Search
USPC ..... 361/118
See application file for complete search history.

(56) References Cited

U.S. PATENT DOCUMENTS 5,991,141 A * 11/1999 Mikli ..... H01C 7/12
361/117
2017/0186575 A1* 6/2017 Strangfeld ..... H01C 7/126

FOREIGN PATENT DOCUMENTS

WO 9717708 A1 5/1997
WO 2008033222 A2 3/2008

OTHER PUBLICATIONS

ABB Schweiz AG, Accompanying letter under Article 19 PCT submitted to the European Patent Office on Feb. 22, 2017 in corresponding Application No. PCT/EP2016/071500, 9 pp.

* cited by examiner

DISCONNECTOR DEVICE FOR SURGE ARRESTER AND A PROTECTION ASSEMBLY COMPRISING A SURGE ARRESTER CONNECTED TO SUCH A DISCONNECTOR DEVICE

Aspects of the present disclosure relate to a disconnector device for permanently disconnecting the current flow in a surge arrester in case of a temporary overvoltage in the electric line lasting longer than a few tenths of milliseconds, e.g. longer than 100 ms extending over a few cycles up to several seconds or more. More particularly, they relate to a disconnector device providing for fire hazard protection.

TECHNICAL BACKGROUND

Metal oxide surge arresters are electrical devices installed in electrical grids in order to protect other electrical apparatuses from the consequences arising of destructive over voltages. Such consequences may result in damages of the electrical system as well as of its components. The working principle is based on a strongly nonlinear characteristic of the resistivity of metal oxide resistors as a function of the applied voltage. This allows a surge arrester to limit the damaging effects of a lightning-effected over voltage by draining currents of many kA to ground for a short time. In comparison, a surge arrester has, under normal service conditions, a leakage current of parts of mA over years of operation.

The maximum continuous voltage $U_c$ defines the condition under which the arrester can work indefinitely. An elevated voltage higher than $U_c$ can be applied for a limited time, which is specified by the manufacturer. Exceeding this specified time will cause a destructive overload, which causes the Metal Oxide surge arrester to reach a thermal limit and to fail, resulting in a short circuit fault and in a permanent damage of the surge arrester.

This failure case is recognized by the international standards IEC 60099-4 and IEEE C62.11a by specification of a short circuit test. According to the test procedure, in order to prevent damages on the equipment installed close to the surge arrester in the substation, the surge arrester has to provide a failure mode without violent shattering of the housing, and shall be able to self-extinguish open flames within 2 minutes after the end of the test.

In regions having high fire hazards like Australia and some arid areas of the United States, additional technical specifications have set more severe requirements for reducing the risk of ignition of a fire: Additional to the normal requirements stated by IEC or IEEE, a surge arrester has to fail without spreading hot particles having enough energy to cause a fire in its surroundings.

This is proven by carrying out a short circuit test with the arrester mounted at a defined height to ground, wherein the ground has been previously covered with a thermal sensitive material which is easily inflammable. For example, Australia standard AS 1307.2 specifies many thin calibrated paper layers on the ground, while USA (Cal fire) specifies a fuel bed comprising dry grass, prepared with fuel.

Previous technical solutions for the protection from fire promotion by a surge arrester are mainly based on the concept of limiting the effect of the arc burning between upper and lower terminals of the surge arrester in case of a fault current. The consequence is that while the surge arrester is overloaded during testing (and later in the field), the overload causes a short circuit failure, and an arc is subsequently burning between the surge arrester terminals.

The terminals are equipped with especially developed electrodes, which shall force the arc to move, thereby limiting the size of the melted metal droplets falling to ground.

For example, EP1566869 B1 discloses a shaped-electrode-concept for arc guiding in a surge arrester.

In view of the above problems, the protection of the environment against unintended fire caused by a current overload shall be improved.

SUMMARY OF THE INVENTION

The problem is solved by a protection assembly of a high voltage surge arrester and a disconnector device, whose first terminal is electrically connected to the high voltage surge arrester and whose second terminal is electrically connected to ground potential. The actual fire prevention is achieved by way of the design of the disconnector device.

In a basic embodiment, the inventive disconnector device comprises:

a housing encompassing a cavity;

a disconnector provided inside the cavity, having a first terminal connectable to the surge arrester, a second terminal connectable to ground potential, and a member provided at the second terminal and being fitted to the cross section of the cavity, and a disconnector cartridge. Said movable member is movably arranged such in the housing that once the disconnector operates in case of a current overload, the member is propelled inside the cavity towards an end of the cavity by gas developing from the disconnector cartridge. This movement entails a mechanical disconnection of the surge arrester from ground potential and eventually a reliable interruption of the electric path in between the grid and the ground potential. The housing comprises further ventilation openings that connect the cavity to an outside of the disconnector device for releasing gases from the operating disconnector cartridge. The ventilation openings are dimensioned such that no particles of harmful size that are potentially capable of igniting a fire can pass the ventilation openings unintentionally. The housing is made of an insulating material such as a polymeric material, for example.

If the movable member shall be prevented from an undesired rebounding from its end position to its initial position, it is advantageous that the cavity has an elongated shape and that the housing has a retaining section for retaining the movable member at the retaining section once the movable member was propelled towards the end of the cavity. In use, such a disconnector device ensures that no unintentional electric connection in between the first terminal connected to the surge arrester and the second terminal connected to ground potential is established in case of an electric overload. That way, the two separated terminals of the device remain spaced from one another in a secure fashion after operation of the disconnector device.

In an exemplary embodiment, the cavity and the movable member have a round cross section or a polygonal cross section, and the cross section of the movable member is fitted to the cross section of the cavity, such that the movable member can move inside the cavity and is thereby guided like a piston in a piston housing or in a cylinder. Generally, the disconnector cartridge and the movable member, optionally also the second terminal, may be provided as an integral part. In a basic embodiment of the cavity, the cross-section of the cavity is constant along a longitudinal axis thereof. When the disconnector operates, the movable member is propelled towards the end of the cavity and is subsequently retained at the end of the cavity by a retaining means. In an embodiment of the retaining means, the housing has a retaining section at an end of the cavity. The movable member engages with the retaining section after being propelled inside the cavity by developing gas from the disconnector cartridge. Thereby, the retaining may be provided by a number of mechanical means such as protrusions, a press-fitting of the movable member into an opening, or the like.

In embodiments, the housing has an opening in the end of the cavity to provide space for a cable to make the electrical connection to ground potential. The movable member and the opening are adjusted to each other, such that a portion of the movable member fits into the opening. In an exemplary embodiment, the opening is closed by a portion of the movable member after operation. The movable member may have a tubular section in embodiments, with a diameter fitting to the opening, so that a movement of the movable member after operation of the disconnector is guided by the opening. That way, the movable member closes the opening and contributes to sealing off the end of the cavity where the movable member is retained in an operating state of the disconnector in the disconnected state of the disconnector.

A disconnector device according to embodiments provides highly effective protection against fire hazard from surge arresters. In case of an overload, a disconnector inside a housing operates and interrupts the current. Due to the design of the device, hot particles are kept from spreading into the surroundings by effectively confining them. Due to the design of the device the two terminals are separated in fast manner from each other during operation by a high acceleration of the one terminal.

Where it is desirable that an observer, for example a staff member can tell from a distance to the housing on whether the disconnector already operated or whether it is still in its pristine state, the following embodiment of the disconnector device might be useful. In such a disconnector device, a portion of the movable member protrudes through the opening and such that it is visible from an outside of the housing after an operation of the disconnector. The term pristine state is understood hereinafter as the initial state of the disconnector device before operation, i.e. before the disconnector cartridge get into action.

The detectability of the state of the disconnector device for an observer can be even more improved, for example the "operated" status, if the portion of the movable member protruding through the opening after operation of the disconnector has a signal colour for indicating visually better on whether the disconnector already operated or whether it is still in its pristine state.

In an exemplary embodiment of the disconnector device the ventilation openings have a slit-like shape extending in the direction of a longitudinal axis defined by the overall shape of the cavity and a moving direction of the movable member, i.e. along the longitudinal axis. Such a setup is advantageous since the cross-section of the ventilation opening is small at the beginning of the movement of the movable member from its initial position. As a result, the gas pressure is available for propelling the movable member from the initial position towards an end position at the end of the cavity. The closer the piston-like movable member comes to the end position at the end of the cavity, the larger the overall cross-section of the ventilation opening becomes such that the gas pressure no longer contributes to propelling the movable member towards the second end to an extent as at the beginning of the operation.

More aspects are provided in the dependent claims, the attached drawings and the following remainder of the description.

BRIEF DESCRIPTION OF THE FIGURES

More details will be described in the following with reference to the figures, wherein.

DETAILED DESCRIPTION OF THE FIGURES AND EMBODIMENTS

Figure 1:
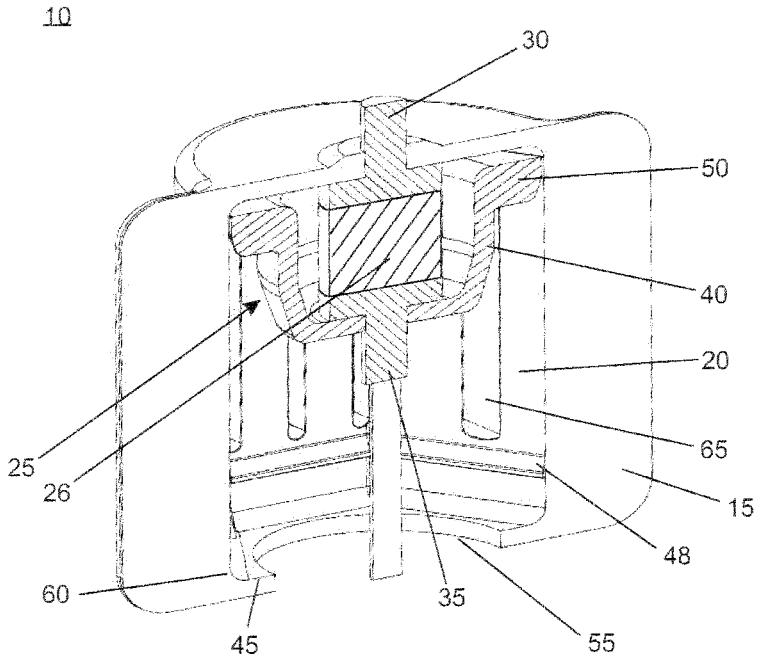
FIG. 1 is a schematic cross-sectional view of a disconnector device according to embodiments.

In FIG. 1, a disconnector device 10 for a surge arrester is shown. The disconnector device 10 has a housing 15, which encompasses a cavity 20. The housing is made of an insulating material, such as a polymeric material. Inside the cavity, a disconnector 25 is provided. The disconnector has a first terminal 30 which protrudes out of the housing 15. The first terminal 30 is configured to be mountable to a surge arrester (not shown in FIG. 1). A second terminal 35 of the disconnector is connectable to ground, for example by means of an electrical cable 36. Between the first terminal 30 and the second terminal 35, a disconnector cartridge 26 is provided. A movable member 40 is provided at the second terminal 35 of the disconnector 25. The movable member is fitted to the cross section of the cavity 20. This is intended to mean that the movable member has a cross sectional outline similar to a first cross section of the cavity.

When the disconnector 25 operates in case of a current overload in the conductive pathway between the first terminal 30 and the second terminal 35 connected to ground, the disconnector cartridge 26 rapidly heats up and causes the disconnector 25 to break apart due to the developing hot gas, which is produced by the disconnector cartridge 26. The technology of disconnector cartridges is well known. As a consequence, the movable member 40 together with the second terminal 35 is propelled inside the cavity 20 by the developing gas (in FIG. 1 the direction would be downwards in the drawing plane). The movable member 40 is adapted with respect to the cavity 20, such that the movable member can freely move inside the cavity. The cross section of the movable member at its largest diameter is slightly smaller than the cross section of the cavity 20. This means, there is in an exemplary embodiment a circumferential slit between the movable member and the housing. The difference in diameter may be from, for example, 0.1 mm to 5 mm, more preferably from 0.5 mm to 3.5 mm. In embodiments, there may optionally be a seal provided at the movable member 40, such that the slit between the movable member 40 and the walls constituting the cavity 20, that is the inner walls of housing 15, is substantially gas tightened by the seal (not shown). The adaption of the cross section of the movable member 40 with respect to the cavity 20 serves to guide the movable member 40 in the housing 15 during operation of the disconnector 25 like a piston in a piston housing.

Figure 2:
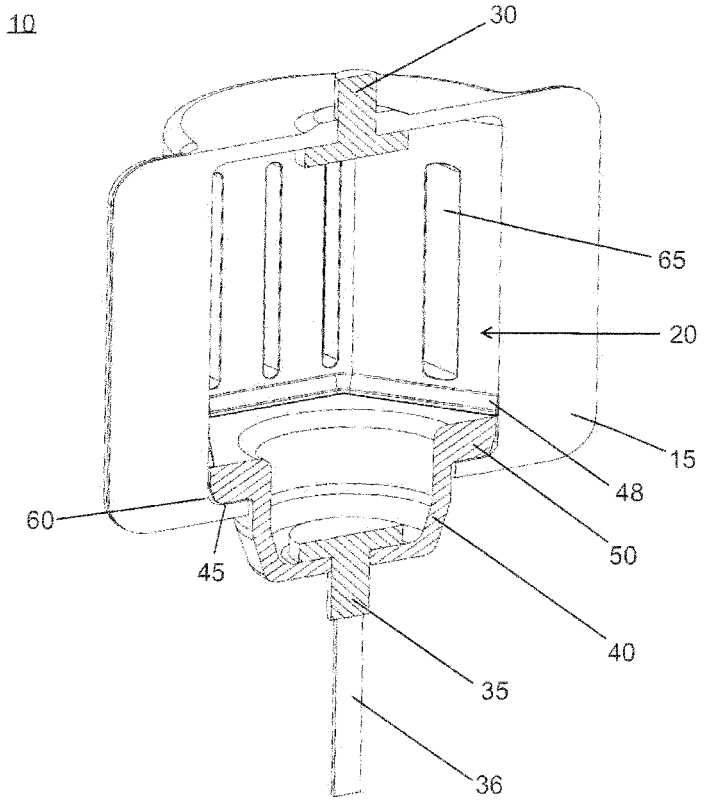
FIG. 2 is a schematic cross-sectional view of the disconnector device of FIG. 1 after operation.

In FIG. 2, the status of the disconnector device 10 after operation of the disconnector device 10 is shown. The disconnector 25 as of FIG. 1 is broken apart. The movable member 40 together with the second terminal 35 has been propelled by the developing gas pressure from the operating disconnector 25 towards the end 45 of the cavity 20.

In FIG. 2, the movable member 40 is located at the end 45 of cavity 20. In embodiments, the housing 15 is shaped such that the movable member 40 is retained in this position, that is the end 45 of cavity 20, after it was propelled by the operating disconnector 25 towards the end 45 of the cavity 20. In order to achieve this, some measures are proposed in the following. It goes without saying that the skilled person might find further means or ways to retain the movable member at an end 45 of the cavity 20 by using his standard knowledge, which variations are regarded to fall under the present disclosure. In FIG. 1, a protrusion 48 is shown, which is a local, circumferential protrusion from the inner walls of housing 15 into the cavity 20. The protrusion 48 is designed such that the movable member 40 may pass it while being propelled by the developing gas from the disconnector 25, but is then retained by the protrusion at the end 45 of the cavity 20, hence in its end position such as depicted in FIG. 2.

Generally, the section of housing 15 adjacent to the end 45 of cavity 20, which serves for retaining the movable member 40, is therefore called retaining section 60. Generally, in embodiments, the housing 15 thus has a retaining section 60, and the retaining section 60 is designed, together with the movable member 40, such that it retains the movable member 40 after operation of the disconnector 25 in such a manner that the movement of the movable member is stopped, and the movable member is retained and permanently held at the end 45 of the cavity 20. At the same time, the cavity 20 is effectively closed, with the exception of ventilation openings described further below. Thus, hot solid particles from the operating disconnector 25 are kept inside the cavity 20, and thus inside the housing 15.

The housing is designed to achieve different functions: It defines together with the movable member 40 a confined variable volume of the cavity 20, that makes use of the blasting energy of the disconnector cartridge 26 to provide a pressure build-up, which is suitable to cause a parting speed of the first terminal 30 (fixed) and the second terminal 35 (initially connected to the propelled movable member, and to ground) which is high enough to clear the overload current. Further, by the retaining of the movable member, a subsequent restrike after current zero is avoided. In the process, the movable member 40 is propelled by the developing gas, thereby providing enough insulation distance between the first terminal and second terminal.

The function of the retaining section 60, and of its just described working principle, is as follows: When a surge arrester, to which the disconnector device 10 of embodiments is attached with its first terminal 30, switches through due to an over voltage, the resulting high current flows through the disconnector device 10 towards ground, which is connected to the second terminal 35. While it flows through disconnector 25, the disconnector cartridge 26 operates after a time span which is determined by the flowing current and the characteristics of the disconnector cartridge 26. The disconnector 25 thus operates, while producing a volume of hot gas and also some solid residues, which are typically very hot. The resulting fast rise of the pressure in the cavity 20 propels the movable member 40 towards the end 45 of the cavity. At the same time, the current flow between the surge arrester and ground (connected to second terminal 35) is interrupted, as the disconnector 25 was previously in the current path. When the movable member 40 would impact on the end 45 of the cavity 20, it would receive a double impulse and would be reflected back towards the first terminal. Due to the high voltage between first terminal and the movable member (connected to ground), the current might thus ignite an arc once the movable member would bounce back towards the first terminal 30. Thus, by retaining the movable member at the end of the cavity 20, and thus in a position distant to the first terminal, the risk of a secondary arc ignition is eliminated.

Generally, in embodiments the disconnector cartridge 26 does usually not carry the complete current through the disconnector device 10. Typically, parallel to the disconnector cartridge, a parallel current path is provided, which is also interrupted when the disconnector 25 operates. This current path is generally omitted in this disclosure for illustrational purposes.

In embodiments, the housing 15 has an opening 55 (see FIG. 1) located in the end 45 of the cavity 20. The movable member 40 and the opening 55 are adjusted to each other, such that after operation of the disconnector 25, a part of the movable member 40 fits into the opening 55 and thereby closes it. Exemplarily, this is shown in FIG. 1 and FIG. 2, while in the latter, the closed status after operation of the disconnector is shown. Thereby, the part of the movable member 40 protruding through the opening 55 is visible from an outside of the housing 15 by a human observer. In order to make the "operated" status more easily detectable by an observer, at least the part of the movable member 40 protruding through the opening 55 (see FIG. 2) may have a signal color, for example red or orange.

As shown in FIG. 1 and FIG. 2, the housing 15 may have optional ventilation openings 65 connecting the cavity 20 to an outside atmosphere, for a faster, controlled release of gas stemming from the operating disconnector 25. The ventilation openings 65 may be slits (also referred to as slots) extending along the cavity 20 in an exemplary embodiment of the housing. For at least a part of the length of the slits, the width of the slits may, in embodiments, increase in the direction towards the end 45 of the cavity 20 (not shown). The effect of the ventilation openings 65 is that the decrease of the gas pressure inside cavity 20 is promoted, while the movable member 40 moves towards the end 45 of the cavity 20. Additionally, the ventilation openings 65 may be covered by a polymeric material, preferably by a polymeric foil, in a pristine state of the disconnector device 10 as shown in FIG. 1. Once the disconnector 25 operates and the pressure in the cavity quickly builds up, the thin film will be torn apart such that the ventilation openings work as intended. The foil protects, for example, against rain and dust which might otherwise accumulate inside the cavity 20 and might hinder the disconnector device to function properly. Generally, the ventilation openings 65 have to be dimensioned in width such that only very small particles from within the cavity 20 arc able to pass them, in order to ensure the purpose of the disconnector device to provide fire protection. Their actual dimensioning is a standard task for a skilled person, thereby it might be taken into account the properties (e.g., particle size) of the residues of the specific disconnector cartridge 25 after its operation.

The cavity 20, as defined by the inner walls of the housing 15, may have different cross sections such as a circle, a pentagon, a hexagon, heptagon, octagon, in general a polygon. In the exemplary embodiments of FIG. 1 and FIG. 2, the cross section is a hexagon (of which only half is shown due to the cross-sectional view). In the embodiments depicted, the movable member 40 has the shape of a cup with a protruding rim 50, having a hexagonal cross section at least at a portion with the largest diameter. In FIG. 1, showing the disconnector device 10 in its pristine state, it can be seen that the cup-shaped movable member 40 partly encompasses the disconnector cartridge 26. In this manner, the volume between the first terminal 30 and the movable member 40 may be designed to be to a significant part taken up by the disconnector cartridge 26. This ensures a very high acceleration when the movable member 40 is propelled by the gas of the operating disconnector cartridge 26. Other possible shapes for the movable member may be a thin disc, a cap with the opening towards the first terminal 30, or a cylinder with low height/diameter ratio, e.g. smaller than 1, more preferred smaller than 0.5.

The first terminal 30 of the disconnector 25 is in some embodiments mounted to the housing 15 by screwing. That is, where the first terminal extends through the housing 15, the housing has an inner thread fitting an outer thread on the first terminal 30.

Figure 3:
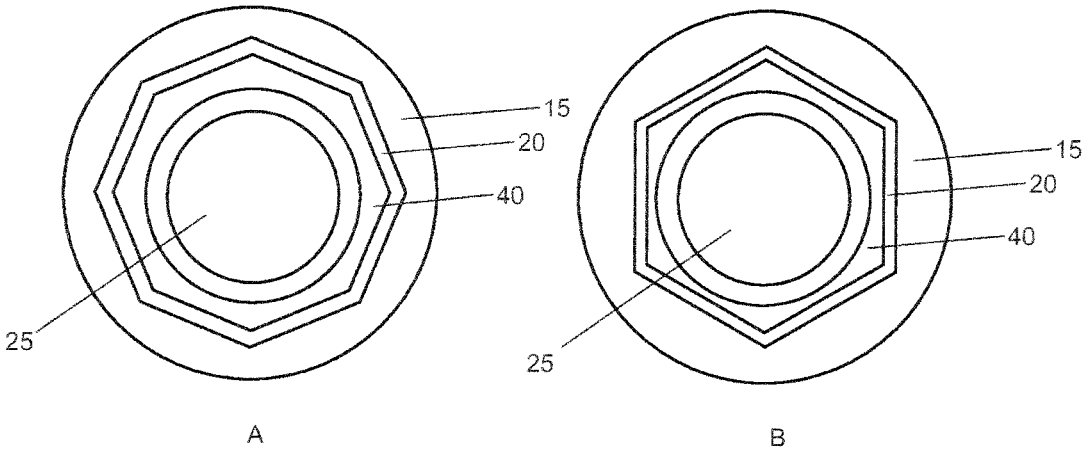
FIG. 3 schematically shows two cross-sectional views of a disconnector device according to embodiments.

In FIG. 3, two exemplary, simplified cross-sectional views of a disconnector device 10 according to embodiments arc shown. In example A, the cavity 20 has an octagonal cross section, in which the movable member 40 with its smaller diameter is shown, wherein between the movable member 40 and the housing 15, the slit is shown being a part of cavity 20. In the middle, the disconnector 25 is shown. In example B, the cavity 20 has a hexagonal cross section, such as also employed in FIG. 1 and FIG. 2.

Figure 4:
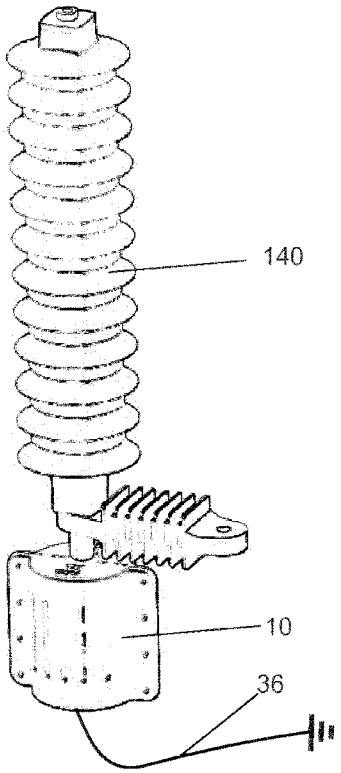
FIG. 4 shows an assembly of a surge arrester with a disconnector device according to embodiments.

In embodiments, the disconnector device 10 may be assembled with a high voltage surge arrester 140, wherein the ground terminal of the high voltage surge arrester 140 is connected to the disconnector device 10. The second terminal of the disconnector (not shown) is electrically connected to ground via the cable 36. Such an assembly is shown in FIG. 4.

Figure 5:
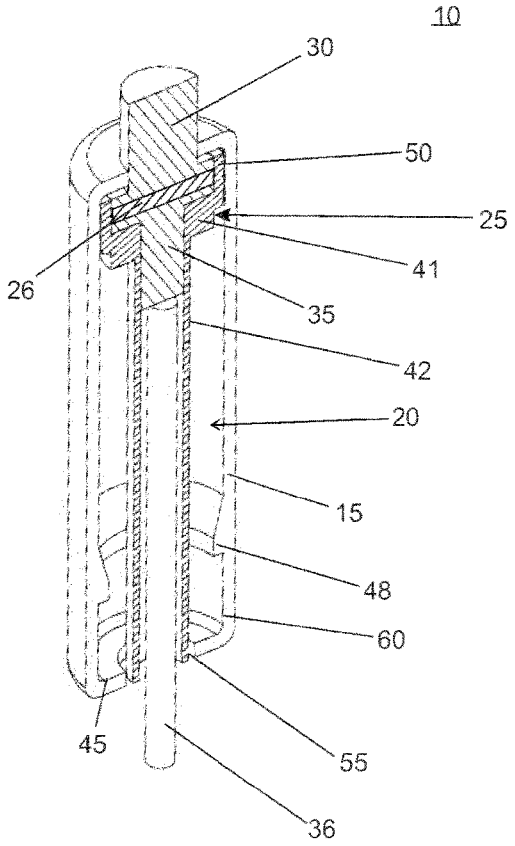
FIG. 5 is a schematic cross-sectional view of a disconnector device according to further embodiments.

In FIG. 5, a further disconnector device 10 for a surge arrester is shown. The disconnector device 10 basically has a similar structure and working principle as the one described with respect to FIG. 1 and FIG. 2. In the following, mostly the differences between the two embodiments are described. In FIG. 5, the cavity 20 in the housing 15 has a circular cross section. Accordingly, the movable member 41, which is fitted to the cross section of the cavity 20 to be movable therein along the longitudinal axis thereof, also has a circular cross section. The adaption of the cross section of the movable member 41 with respect to the cavity 20 serves to guide the movable member 41 in the housing 15 during operation of the disconnector 25, like a piston in a piston housing. The movable member 41 has, apart from its circular cross section, basically the same properties as the movable member 40 in FIG. 1, is cup shaped, but has an additional tubular section 42 with a tube-like or cylindrical shape. The tubular section 42 has a smaller diameter than the movable member 40, from about 10 percent to about 70 percent of the diameter of the movable member. The diameter of the tubular section 42 and the diameter of the opening 55 are adjusted to each other so that the tubular section 42 can move freely in the opening. In this embodiment, there is only a small circumferential gap between the opening and the tubular section 42, for example from 0.1 mm to 5 mm, more preferred from 0.5 mm to 3.5 mm. Hence, when the disconnector cartridge 26 operates and propels the movable member 41 towards the end 45 of cavity 20, the movement of the movable member 41 is guided twofold, once by the part with the largest diameter of the movable member 41 inside cavity 20, and second by the tubular section 42 through opening 55.

Figure 6:
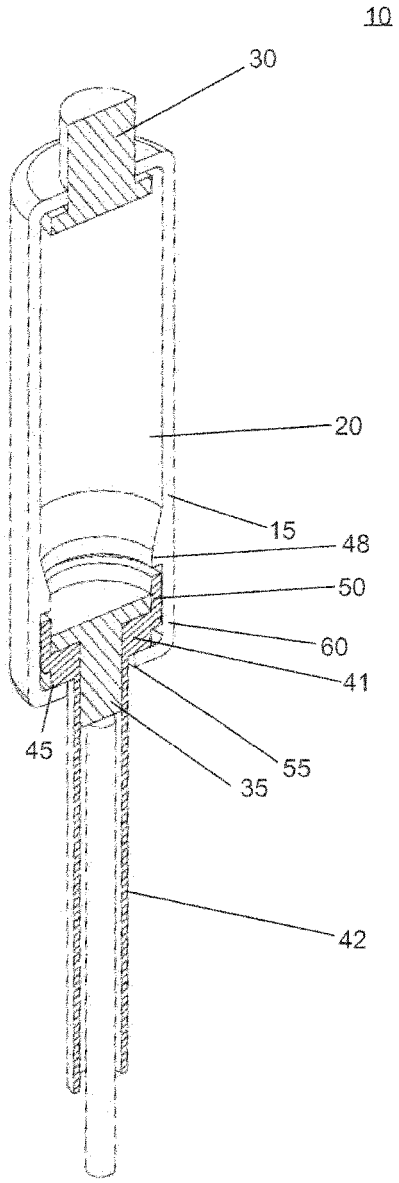
FIG. 6 is a schematic cross-sectional view of the disconnector device of FIG. 5 after operation.

In FIG. 6, the status of the disconnector device 10 of FIG. 5 after operation of the disconnector device 10 is shown. The disconnector 25 as of FIG. 5 is broken apart, thus, the disconnector cartridge 26 has vanished. The movable member 41, together with the tubular section 42 and the second terminal 35 has been propelled by the developing gas pressure from the operating disconnector 25 towards the end 45 of the cavity 20. As described with respect to FIG. 1 and FIG. 2, the movable member 41 has been retained at the end 45 of the cavity 20 by the retaining section 60. The tubular section 42 protrudes out of the housing indicating the operating state of the disconnector.

In FIG. 5 and FIG. 6, the housing 15 has no ventilation openings 65, such as shown in FIG. 1, for example. Thus, hot particles from the operating disconnector 25 are completely kept inside the cavity 20, and thus inside the housing 15. The elevated gas pressure of the developing gas from the operating disconnector 25 can be withheld by the housing 15 or will dissolve by gas passing through small openings such as the gap between the movable member and the housing, and subsequently between the tubular section 42 and the opening 55.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A disconnector device for a surge arrester, the disconnector device comprising:

a housing encompassing a cavity;

a disconnector provided inside the cavity, having a first terminal connectable to the surge arrester, a second terminal connectable to ground potential, and a movable member provided at the second terminal and being fitted to the cross section of the cavity, and a disconnector cartridge;

wherein the movable member is movably arranged such in the housing that once the disconnector operates, the movable member is propelled inside the cavity towards an end of the cavity by gas from the disconnector cartridge, and wherein the housing has ventilation openings connecting the cavity to an outside of the disconnector device for releasing gases from the operating disconnector cartridge, the ventilation openings being dimensioned such that no particles harmful size that are potentially capable of igniting a fire can pass the ventilation openings;

wherein the cavity has an elongated shape, and wherein the housing has a retaining section for retaining the movable member at the retaining section once the movable member was propelled towards the end of the cavity; and wherein the ventilation openings are slits extending along the cavity in a direction of a longitudinal axis defined by the overall shape of the cavity.

2. The disconnector device of claim 1, wherein the housing has an opening at the end of the cavity, and wherein the movable member and the opening are adjusted to each other such that a portion of the movable member fits into the opening and thereby closes it in an operating state of the disconnector.

3. The disconnector device of claim 2, wherein the movable member has a tubular section with a diameter fitting to the opening, so that a movement of the movable member during operation of the disconnector is guided by the opening.

4. The disconnector device of claim 2, wherein after an operation of the disconnector, a portion of the movable member protrudes through the opening such that it is visible from an outside of the housing.

5. The disconnector device of claim 4, wherein the portion of the movable member that is protruding through the opening is formed by the tubular section.

6. The disconnector device of claim 5, wherein at least the portion of the movable member protruding through the opening after operation of the disconnector has a signal color for indicating on whether the disconnector already operated or whether it is still in its pristine state.

7. The disconnector device of claim 4, wherein at least the portion of the movable member protruding through the opening after operation of the disconnector has a signal color for indicating on whether the disconnector already operated or whether it is still in its pristine state.

8. The disconnector device of claim 2, wherein the ventilation openings are designed for a controlled release of gases from the operating disconnector cartridge.

9. The disconnector device of claim 2, wherein the ventilation openings are slits extending along the cavity in a direction of a longitudinal axis defined by the overall shape of the cavity.

10. The disconnector device of claim 2, wherein the cavity has a circular cross section or a polygonal cross section.

11. The disconnector device of claim 2, wherein at least a part of the movable member has a cup shape, and wherein the cup at least partly encompasses the disconnector cartridge.

12. The disconnector device of claim 2, wherein the retaining section of the housing has at least one protrusion protruding into the cavity.

13. The disconnector device of claim 2, wherein the housing is mounted to the first terminal of the disconnector.

14. The disconnector device of claim 1, wherein the ventilation openings are designed for a controlled release of gases from the operating disconnector cartridge.

15. The disconnector device of claim 1, wherein the cavity has a circular cross section or a polygonal cross section.

16. The disconnector device of claim 1, wherein at least a part of the movable member has a cup shape, and wherein the cup at least partly encompasses the disconnector cartridge.

17. The disconnector device of claim 1, wherein the retaining section of the housing has at least one protrusion protruding into the cavity.

18. The disconnector device of claim 1, wherein the housing is mounted to the first terminal of the disconnector.

19. An assembly of a high voltage surge arrester and a disconnector device of claim 1, wherein the first terminal of the disconnector device is electrically connected to the high voltage surge arrester.

* * * * *